United States Patent [19]

Ohsaki

[11] Patent Number: 4,623,274

[45] Date of Patent: Nov. 18, 1986

[54] INK RIBBON CARTRIDGE

[75] Inventor: Ryouhei Ohsaki, Tokyo, Japan

[73] Assignee: Oki Electric Industry Co., Ltd., Tokyo, Japan

[21] Appl. No.: 726,388

[22] Filed: Apr. 23, 1985

[30] Foreign Application Priority Data

Apr. 23, 1984 [JP] Japan ..... 59-58533

[51] Int. Cl.[4] ..... D41J 32/02

[52] U.S. Cl. ..... 400/208; 400/234; 400/196.1

[58] Field of Search ..... 400/208, 196, 196.1, 400/234; 242/198

[56] References Cited

U.S. PATENT DOCUMENTS

| | | | |
|---|---|---|---|
| 4,273,453 | 6/1981 | Haftmann | 400/234 |
| 4,290,567 | 9/1981 | Saito | 242/198 |
| 4,397,574 | 8/1983 | Wojdyla | 400/234 |
| 4,446,790 | 5/1984 | Konkel et al. | 400/208 |
| 4,449,838 | 5/1984 | Okamnra et al. | 400/234 |
| 4,479,729 | 10/1984 | Irro | 400/196.1 |
| 4,497,008 | 1/1985 | Schoenmakers | 242/198 |

FOREIGN PATENT DOCUMENTS

| | | | |
|---|---|---|---|
| 77180 | 6/1981 | Japan | 400/234 |
| 155985 | 9/1983 | Japan | 400/208 |
| 2108928 | 5/1983 | United Kingdom | 400/208 |
| 2141073 | 12/1984 | United Kingdom | 400/208 |

*Primary Examiner*—William Pieprz

*Attorney, Agent, or Firm*—Wenderoth, Lind and Ponack

[57] ABSTRACT

An ink ribbon cartridge for use in an impact printer has a pair of spaced ribbon guide arms pivotally mounted on a cartridge case. An endless ink ribbon is stored in a storage space in the cartridge case. A feed roller is drivably mounted in the cartridge case. A roller guide is pivotally mounted in the cartridge case and has a hook engageable by a post on the rear end of one of the ribbon guide arms. A pressure roller is rotatably mounted on the roller guide and movable toward and away from the feed roller in response to angular movement of the roller guide. The pressure roller is normally urged by a spring to move toward the feed roller. The ribbon guide arms are angularly movable between an open position in which the post disengages from the hook to allow the pressure roller to be displaced toward the feed roller under the force of the spring for gripping the ink ribbon and feeding the same into the storage space in response to rotation of the feed roller, and a closed position in which the post engages the hook to cause the pressure roller to be displaced away from the feed roller against the force of the spring to release the ink ribbon from the feed and pressure rollers.

5 Claims, 3 Drawing Figures

INK RIBBON CARTRIDGE

BACKGROUND OF THE INVENTION

1. Field of the Invention:

The invention relates to an ink ribbon cartridge for use in an impact printer.

2. Description of the Prior Art:

Known ink ribbon cartridges for use in impact printers include a cartridge case having a storage space and an endless ink ribbon folded in the storage space. The endless ink ribbon has a portion drawn out of the storage space by and between the distal ends of a pair of ribbon guide arms projecting from a front portion of the cartridge case. The drawn ink ribbon portion is positioned between a print head and a print sheet, and desired characters are printed by the print head on the print sheet through the ink ribbon. In the cartridge case, the ink ribbon is gripped by a pair of rollers which are rotated to pull the ink ribbon so as to guide the same into the storage space.

The aforesaid ink ribbon cartridge is disclosed in Japanese Patent Publication No. 57-22026 published on May 11, 1982 and Japanese Laid-Open Utility Model Publication No. 57-57954 published on Apr. 5, 1982.

When the conventional ink ribbon cartridge is in storage or is not in use for a long time, the same portion of the ink ribbon remains gripped by the rollers and tends to stick to them. At the time the rollers are rotated when the ribbon cartridge is in use, the ink ribbon is liable to be wound around the rollers, resulting in an ink ribbon jam. Furthermore, the ink may be squeezed out of the ink ribbon where it is gripped by the rollers. When characters are printed by the squeezed portion of the ink ribbon, the printing density is reduced and the printed characters may not be readable.

SUMMARY OF THE INVENTION

It is an object of the present invention to provide an ink ribbon cartridge which will eliminate the aforesaid problems with the prior ribbon cartridge.

To accomplish the above object, an ink ribbon cartridge of the present invention includes a pair of ribbon guide arms angularly movably mounted on the front portion of a cartridge case so that the ribbon guide arms will be opened and closed. An ink ribbon stored in the cartridge case is gripped by a pair of rollers, one of which is rotatably supported on an angularly movable roller guide having a hook engageable with the rear end of one of the ribbon guide arms.

When the ribbon guide arms are closed at the time the ribbon cartridge is not in use, the rear end of said one ribbon guide arm is brought into engagement with the hook of the roller guide, which is turned to move the roller mounted thereon away from the other roller to release the ink ribbon from the rollers.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
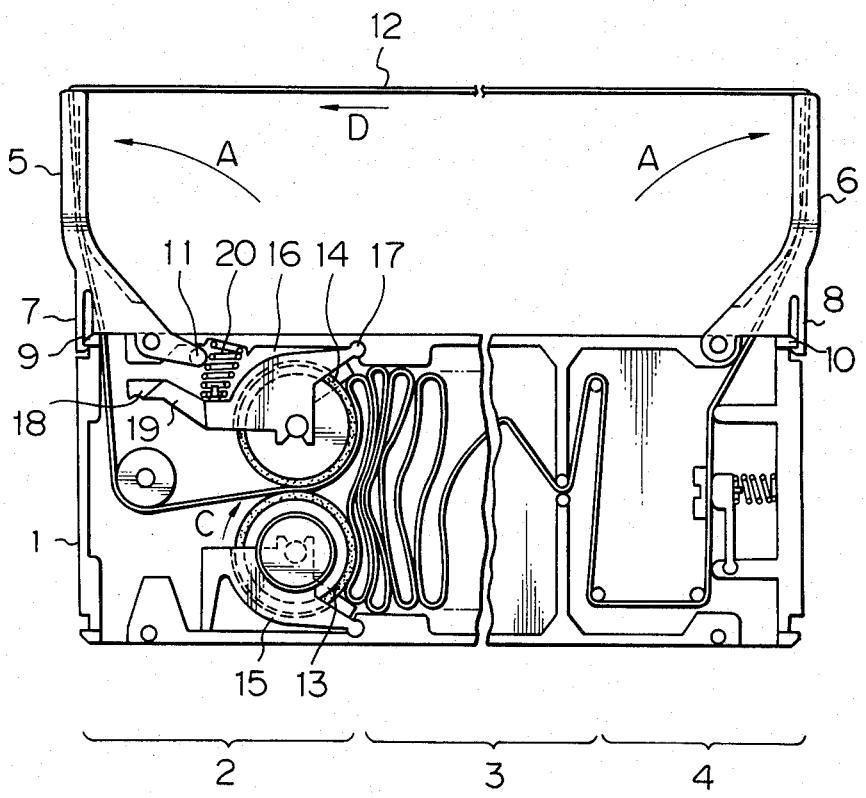
FIG. 1 is a plan view, partly cut away, of an ink ribbon cartridge according to the present invention, the ink ribbon cartridge being shown as in use.
Figure 2:
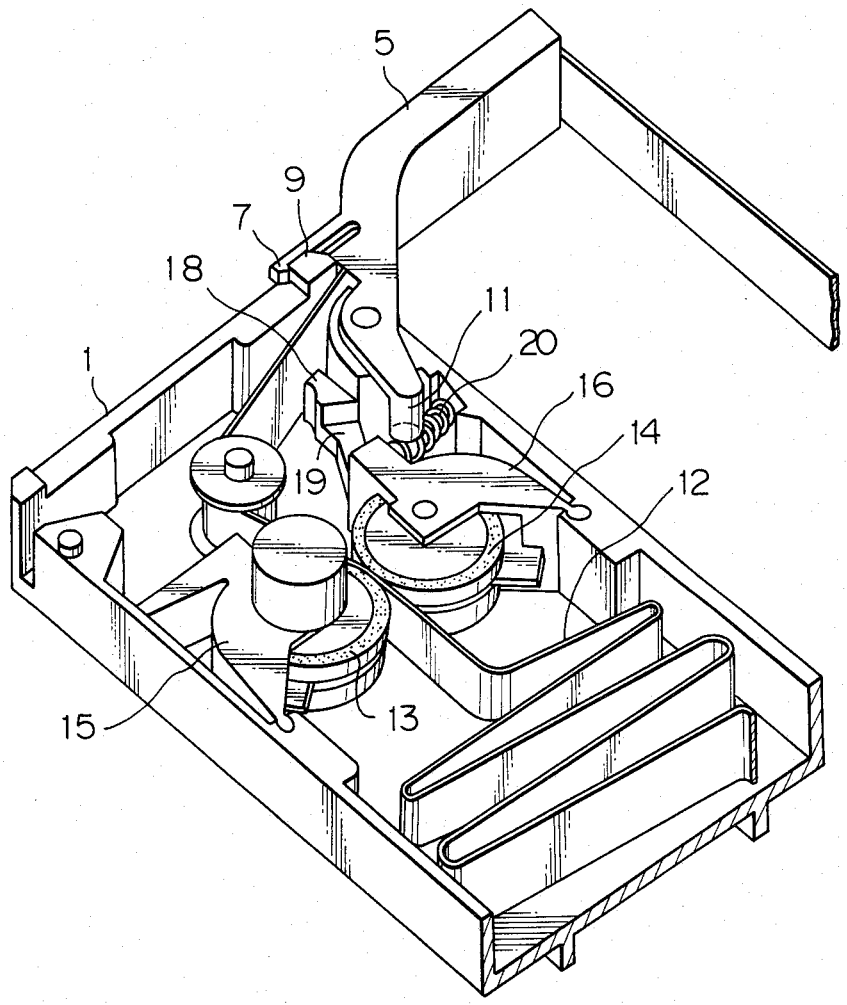
FIG. 2 is a fragmentary perspective view of an ink ribbon pulling mechanism in the ink ribbon cartridge.

As shown in FIGS. 1 and 2, an ink ribbon cartridge includes a cartridge case 1 composed largely of an ink ribbon withdrawal section 2, a storage space 3, and an ink ribbon discharge section 4.

Figure 3:
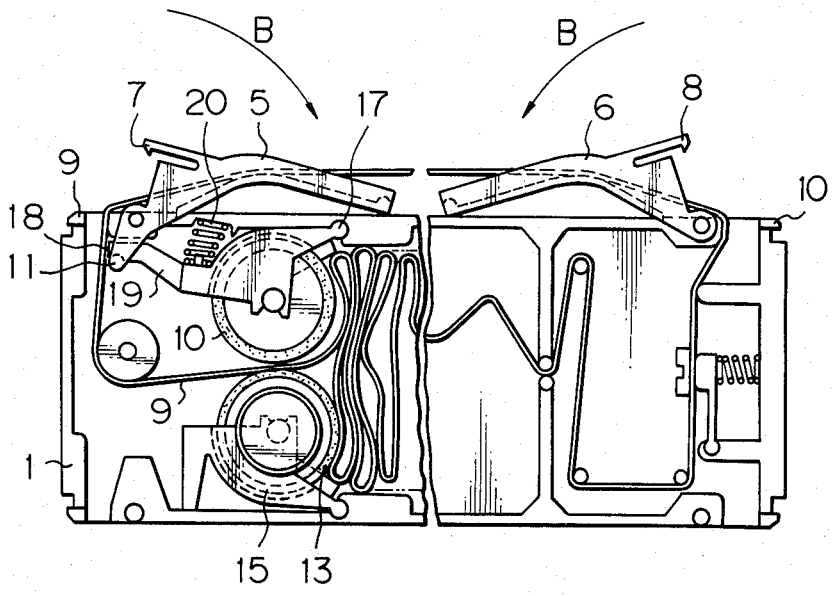
FIG. 3 is a plan view, partly cut away, of the ink ribbon cartridge while not in use.

The ink ribbon cartridge also has a pair of angularly shaped, symmetrical ribbon guide arms 5, 6 pivotally mounted on the opposite ends of a front portion of the cartridge case 1. When the ink ribbon cartridge is not in use for a long time or is in storage, it is detached from the printer. At this time, the ribbon guide arms 5, 6 are turned toward each other or closed in the directions of the arrows B as shown in FIG. 3 for easier handling of the ink ribbon cartridge. The ribbon guide arms 5, 6 are also closed to reduce the volume of the ink ribbon cartridge when it is packaged.

When the ink ribbon cartridge is in use, however, the ribbon guide arms 5, 6 are turned away from each other or opened in the directions of the arrow A as shown in FIG. 1, so that the ink ribbon cartridge can easily be loaded into the printer.

The ribbon guide arms 5, 6 have resilient locking pawls 7, 8 on their outer surfaces. The cartridge case 1 has locking projections 9, 10 on opposite sides thereof. When the ribbon guide arms 5, 6 are opened at the time the ink ribbon cartridge is used, the locking pawls 7, 8 are brought into engagement with the locking projections 9, 10 to keep the ribbon guide arms 5, 6 open.

The ribbon guide arm 5 near the withdrawal section 2 has a rear end positioned in the cartridge case 1 and having a post 11.

An endless ink ribbon 12 has its most portion folded in an undulating manner and stored in the storage space 3. The endless ink ribbon 12 has a portion drawn out of an outlet of the discharge section 4 and extending from the distal end of the ribbon guide arm 6 near the discharge section 4 through the distal end of the ribbon guide arm 5 and also through an inlet of the withdrawal section 2 into the storage space 3.

The withdrawal section 2 accommodates a feed roller 13 having a peripheral layer made of a material having a high coefficient of friction, and a pressure roller 14 coacting with the feed roller 13. The feed and pressure rollers 13, 14 are rotatably mounted respectively on roller guides 15, 16. The roller guide 15 supporting the feed roller 13 is mounted on a rear wall of the withdrawal section 2. When the ribbon cartridge is loaded in the printer, the feed roller 13 can be rotated in the direction of the arrow C by means of a drive source (not shown). The roller guide 16 supporting the pressure roller 14 has an end 17 pivotally mounted on a front wall of the withdrawal section 2 so that the pressure roller 14 can be moved toward and away from the feed roller 13. The roller guide 16 has on its opposite end a hook 18 and an adjacent recess 19. When the ribbon guide arm 5 is closed in the direction of the arrow B, the post 11 on the rear end thereof is brought into engagement with the hook 18 through the recess 19.

A pressure spring 20 acts between the front wall of the withdrawal section 2 and the roller guide 16 for normally urging the roller guide 16 to turn about its pivot end 17 toward the feed roller 13.

Operation of the ink ribbon cartridge thus constructed is as follows.

When the ink ribbon cartridge is to be used, the ribbon guide arms 5, 6 are opened in the directions of the arrows A as shown in FIGS. 1 and 2. Since the post 11 of the ribbon guide arm 5 and the hook 18 of the roller guide 16 are not in engagement with each other, the pressure roller 14 is biased by the spring 20 toward the feed roller 13 to grip the ink ribbon 12 therebetween.

The ink ribbon cartridge is now loaded into the printer, and the feed roller 13 is rotated by the non-illustrated drive source in the direction of the arrow C. The ink ribbon 12 is withdrawn by the feed roller 13 and the pressure roller 14 into the storage space 2. At the same time, the ink ribbon 12 is discharged from the discharge section 4. The ink ribbon 12 thus travels in the direction of the arrow D (FIG. 1) between the ribbon guide arms 5, 6. While the ink ribbon 12 is being fed along, desired characters can be printed on a print sheet by a print head.

When the ink ribbon cartridge is in storage or is not in use for a long time and hence is removed from the printer, the ribbon guide arms 5, 6 are closed as illustrated in FIG. 3. The post 11 of the ribbon guide arm 5 is moved through the recess 19 into engagement with the hook 18. When the ribbon guide arm 5 is completely closed, the hook 18 is pushed by the post 11. The roller guide 16 is turned about the pivot end 17 in the direction away from the feed roller 13, whereupon the pressure roller 14 on the roller guide 16 is moved away from the feed roller 13. The ink ribbon 12 is now released from the gripped condition.

Therefore, the ink ribbon does not remain gripped by the rollers 13, 14 when the ink ribbon cartridge is not in use for a long time or is in storage. The ink ribbon is thus prevented from being jammed. Since no ink is squeezed out of the ink ribbon because it is not gripped by the rollers 13, 14 when not in use, the problem of a reduced printing density is also avoided.

Although a certain preferred embodiment has been shown and described, it should be understood that many changes and modifications may be made therein without departing from the scope of the appended claims.

What is claimed is:

1. An ink ribbon cartridge comprising:

(a) a cartridge case having a storage space;

(b) a pair of spaced ribbon guide arms pivotally mounted on said cartridge case, one of said ribbon guide arms having a rear end projecting into said cartridge case;

(c) an endless ink ribbon stored in said storage space and having a portion extending through and between said ribbon guide arms;

(d) a feed roller drivably mounted in said cartridge case;

(e) a roller guide pivotally mounted in said cartridge case and having a hook engageable by said rear end of said one ribbon guide arm;

(f) a pressure roller rotatably mounted on said roller guide and movable toward and away from said feed roller in response to angular movement of said roller guide; and (g) a spring acting between said roller guide and said cartridge case for normally urging said pressure roller toward said feed roller;

(h) said ribbon guide arms being angularly movable between an open position in which said rear end disengages from said hook to allow said pressure roller to be displaced toward said feed roller under the force of said spring for gripping said ink ribbon and feeding the same into said storage space in response to rotation of said feed roller, and a closed position in which said rear end engages said hook to cause said pressure roller to be displaced away from said feed roller against the force of said spring to release said ink ribbon from said feed and pressure rollers.

2. An ink ribbon cartridge according to claim 1, wherein said rear end of said one ribbon guide arm has a post thereon for engagement with said hook.

3. An ink ribbon cartridge according to claim 2, wherein said roller guide has a recess adjacent to said hook for allowing said post to pass therethrough and engage said hook.

4. An ink ribbon cartridge according to claim 1, wherein said roller guide has an end remote from said hook and pivotally mounted on said cartridge case.

5. An ink ribbon cartridge according to claim 1, wherein said ribbon guide arms have respective locking pawls, said cartridge case having locking projections for engaging said locking pawls when said ribbon guide arms are in said open position.

* * * * *